United States Patent [19]

Gerbe

[11] Patent Number: 4,618,117

[45] Date of Patent: Oct. 21, 1986

[54] WALL MOUNT FOR AN ACCESSORY

[75] Inventor: Helmut Gerbe, Iserlohn, Fed. Rep. of Germany

[73] Assignee: KEUCO Paul Keune GmbH & Co. KG, Hemer, Del.X

[21] Appl. No.: 559,177

[22] Filed: Dec. 7, 1983

[30] Foreign Application Priority Data

Jun. 30, 1983 [DE] Fed. Rep. of Germany ..... 3323571

[51] Int. Cl.[4] ..... F16B 7/00

[52] U.S. Cl. ..... 248/222.1; 248/231.3; 248/251; 248/500; 403/323

[58] Field of Search ..... 248/201, 220.2, 222.1, 248/222.2, 222.3, 225.31, 231.3, 251, 500; 403/323, 324; 211/105.1; 24/606, 607

[56] References Cited

U.S. PATENT DOCUMENTS

| | | | |
|---|---|---|---|
| 1,838,935 | 12/1931 | Fixsen | 248/251 |
| 1,962,739 | 6/1934 | Hoegger | 248/251 |
| 2,158,734 | 5/1939 | Sladek | 248/251 |
| 3,881,334 | 5/1975 | Wilson | 403/323 |
| 4,509,882 | 4/1985 | Lautenschlager | 403/323 |

FOREIGN PATENT DOCUMENTS

| | | | |
|---|---|---|---|
| 2260836 | 6/1974 | Fed. Rep. of Germany . | |
| 2026850 | 9/1970 | France . | |
| 37192 | 1/1936 | Netherlands . | |
| 748064 | 7/1980 | U.S.S.R. | 403/323 |

*Primary Examiner*—J. Franklin Foss
*Assistant Examiner*—Robert A. Olson
*Attorney, Agent, or Firm*—Spencer & Frank

[57] ABSTRACT

A wall mount for an accessory comprises a base plate, a cover extending over the base plate in an assembled state of the wall mount and a clamping mechanism for releasably tightening the cover to the base plate in the assembled state of the wall mount. The clamping mechanism includes a receiving part affixed to the base plate and having an inner cylindrical wall defining a cylindrical space; and a bolt having a journal end for being rotatably supported in a bearing provided in the cover. The journal end has a journal axis coinciding with the bearing axis. The bolt has a length portion which is eccentric with respect to the bearing axis. In the assembled state of the wall mount the journal end is received in the bearing and the eccentric length portion is received in the cylindrical space. In the assembled state the bolt has a first angular position in which the eccentric portion of the bolt is clamped to the inner cylindrical wall, whereby the cover is drawn against the base plate and a second angular position in which the eccentric portion of the bolt is in a released condition with respect to the inner cylindrical wall.

4 Claims, 11 Drawing Figures

WALL MOUNT FOR AN ACCESSORY

BACKGROUND OF THE INVENTION

This invention relates to a wall mount for attaching an accessory to a wall surface. The wall mount includes a base plate provided with openings for passage of wood screws for immobilizing the base plate against the wall surface, as well as one part of a screw-actuated fastening device for releasably tightening the accessory to the base plate and further, a cover which includes another portion of the fastening device and which forms part of the accessory.

Wall mounts of the above-outlined known type serve for securing accessories such as hand rails, towel holders, shelves, glass holders, soap dishes and the like to a wall surface. At a selected location the base plate is secured to the wall by means of screws (such as wood screws) and thereafter the cover which forms a part of the accessory is placed over the base plate and is tightened thereto by means of an externally accessible tightening device. Thus, the accessory is mounted on the wall with the intermediary of the cover.

It is a disadvantage of the above-outlined prior art structures that it is often difficult to so arrange the cover that its outer edge lies tightly against the wall, so that during service the accessory does not wobble. Since the wall surface is often uneven, particularly in case of a tile wall, measures have to be taken to ensure that the accessory is well immobilized against the wall. Thus, according to a prior art arrangement, the base plate of the wall mount has at its upper and lower edge an angled part oriented towards the cover. One of the angled edges is provided with a groove extending along a central plane. The cover is provided with a notch in a central plane at one side and with a headless setscrew on an opposite side. One of the angled edges extends into the notch, while the headless screw slides in the groove upon tightening. Since the cover has to be slid over the base plate with a substantial clearance, it follows that during the tightening step the headless screw has to be turned several revolutions until the cover lies against the base plate. Also, the permanent pressing of the cover against the wall requires a significant torque which has to be applied to the headless setscrew. During this operation, the risks are high that one part of the headless setscrew breaks which involves a significant time loss and added expense for removing the damaged screw and replacing it with a new screw. Further, there are considerable risks of slippage of the screwdriver from the headless setscrew, resulting in damages to the highly polished accessory. In addition, after a certain period of use, soiling and oxidation are unavoidable; these occurrences significantly increase the risks of breakage of the headless screw and thus make a removal (disassembly) of the accessory more difficult.

SUMMARY OF THE INVENTION

It is an object of the invention to provide an improved wall mount of the above-outlined type in which less than one-half of a revolution of the fastening device suffices to tighten the cover to the base plate and against the wall.

This object and others to become apparent as the specification progresses, are accomplished by the invention, according to which, briefly stated, the wall mount comprises a receiving part defining a cylindrical space into which extends one part of a clamping bolt which journals in the cover and which is externally accessible by a turning tool. The bolt has a part which is arranged eccentrically with respect to the journal (rotary) axis of the bolt which is situated in the cylindrical space. As the bolt is turned, the eccentric part of the bolt is clamped against the receiving part, whereby the cover is urged towards the base plate and against the wall surface.

According to the invention, the cover of the accessory is placed over the base plate until the edge of the cover lies against the wall where the base plate is mounted. During this motion the bolt is radially introduced into the hollow space of the receiving part (if the bolt is, according to one preferred embodiment, permanently supported at its end in the cover) or is, with an end, axially introduced into an opening in the cover (if the bolt is, according to another preferred embodiment, permanently supported in the base plate). Thereafter, the bolt, at its externally accessible slotted end, needs to be turned only to an extent until the eccentric portion of the bolt is forced in clamping engagement with the bolt-receiving part of the base plate. The rotary tightening (clamping) motion of the bolt is less than 180° and, as a rule, even less than 90°. By virtue of the invention, a movement of the cover along a notch with a subsequent clamping no longer occurs and therefore the torque to be applied is correspondingly smaller. A disassembly (removal) of the accessory at a later point in time is significantly facilitated. The size of the eccentric bolt is greater than that of the headless screw in prior art arrangements.

DESCRIPTION OF THE PREFERRED EMBODIMENTS

Figure 1:
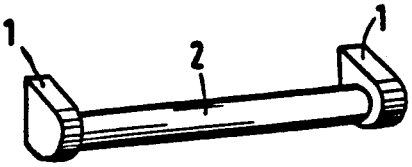
FIG. 1 is a perspective view of an accessory, such as a hand rail, incorporating a wall mount according to the invention.
Figure 6:
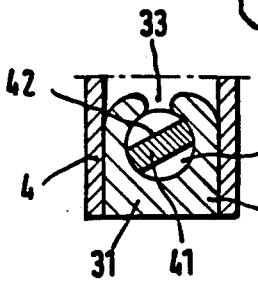
FIG. 6 is a sectional view taken along line VI—VI of FIG. 5.

FIG. 1 shows a hand rail assembly generally mounted on a bathroom wall immediately above the bathtub. The hand rail assembly comprises two wall mounts 1 which support opposite ends of a hand rail 2 proper.

Figure 3:
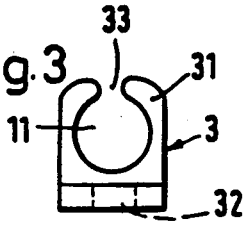
FIG. 3 is an elevational end view of the structure shown in FIG. 2.
Figure 5:
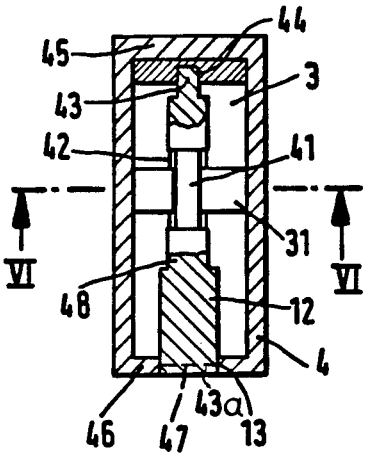
FIG. 5 is a sectional end view of the assembly formed of the component of FIGS. 2 and 3 and the component of FIG. 4.
Figure 4:
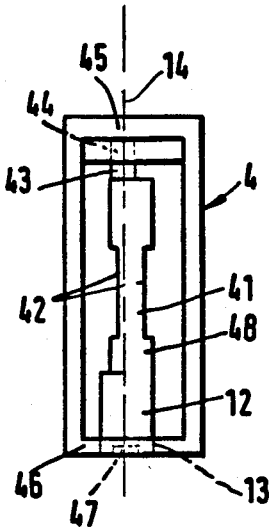
FIG. 4 is a bottom plan view of another component of the same embodiment.
Figure 2:
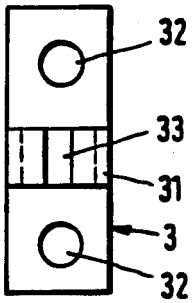
FIG. 2 is a top plan view of a component of a preferred embodiment.
Figure 7:
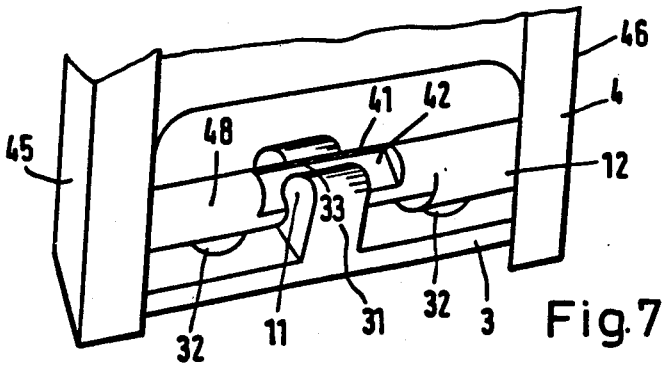
FIG. 7 is a perspective, broken-away view of the structure of FIG. 5.
Figure 9:
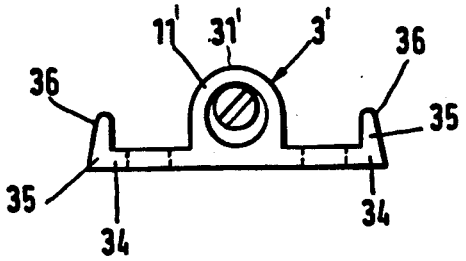
FIG. 9 is an end elevational view of the structure of FIG. 8.

Turning now to FIGS. 2, 3 and 4, each wall mount has a base plate 3 by means of which the accessory (i.e. the hand rail assembly) is secured to the wall and a cover 4 which supports the hand rail 2 and which is form-fittingly and releasably connected with the base plate 3 as it will be described in detail below. The attachment of the hand rail 2 to the cover 4 is effected in a conventional manner which has no bearing on the invention and which is therefore not described in further detail.

It is to be understood that instead of a hand rail, other accessories such as wall bars, towel holders, shelves, glass holders, soap dishes or the like may be secured to a wall by means of a single wall mount or a plurality of wall mounts according to the invention.

For providing a releasable clamped-together connection between the base plate 3 and the cover 4, there is provided a clamping device essentially comprising a bolt 12 rotatably supported at its opposite ends in the cover 4 and an upwardly open, cradle-like receiving part 31 which is affixed to the base plate 3 and which has a cylindrical space 11 adapted to accommodate the bolt 12. The bolt 12 has a part 48 which is eccentric with respect to the bearing axis 14 defined by a bearing opening (bearing recess) 13 provided in the cover 4 and receiving an end portion of the bolt 12. Thus, the axis 14 is the journal axis of the bolt 12. The eccentric part 48 has a portion 41 along which the bolt 12 fits into the cylindrical space 11 of the receiving part 31. The cylindrical space 11 is axially aligned with the axis 14 when components 3 and 4 are assembled together.

In the embodiment illustrated in FIGS. 2 through 7 the base plate 3 has an elongated rectangular outline as may be observed in FIG. 2. It is to be understood that differently shaped outlines are feasible. From opposite shorter ends of the base plate 3, approximately at a distance of one-quarter of the total length of the base plate, there are provided openings 32 for the passage of screws with which the base plate 3 is attached to the wall. The hollow cylindrical space 11 of the receiving part 31 is arranged medially thereof. The cradle-like receiving part 31 has, on its side oriented towards the cover 4, an elongated opening 33 aligned with the longitudinal center plane of the wall mount 1. The width of the slot 33 is less than the diameter of the cylindrical receiving chamber 11.

The outer diameter of the bolt 12, at least along the length portion 41 received in the receiving part 31, equals the diameter of the cylindrical space 11. Along that length portion, at diametrically opposite sides, there are provided flat surfaces 42 to permit the bolt 12 to be inserted into the receiving part 31 through the elongated opening 33. Since the length portion 41 within the cylindrical space 11 is eccentric with respect of the support axis (rotary axis) 14 of the bolt 12, upon rotation thereof it is clamped firmly against the inner face of the receiving part 31, defining the cylindrical space 11.

The bolt 12 further has a journal end 43 which is received in a bearing bore 44 provided at a lateral wall 45 of the cover 4. The oppositely located lateral wall 46 of the cover 4 has the throughgoing bearing opening 13 into which the respective other end (journal end) 43*a* of the bolt 12 is received. The journal end 43*a* has at its terminal radial face an externally oriented radial slot 47 adapted to be engaged by a screwdriver introduced from the outside. The journal end 43 is arranged in alignment with the bearing axis 14. The inner dimensions of the cover 4 are essentially identical to the outer dimensions of the base plate 3. In the illustrated embodiment the inner configuration of the cover 4 is rectangular.

The cover 4 may be inserted onto the base plate 3 until the edge of the cover 4 arrives into engagement with the wall on which the accessory is to be secured. Expediently, the slot 47 of the bolt 12 extends parallel to the flat faces 42 whereby the position of the slot 47 readily indicates to the installer the position of the flat faces 42. Upon insertion of the cover 4 onto the base plate 3 the faces 42 of the cover 4 pass through the elongated opening 33 of the receiving member 31 until they are situated within the cylindrical space 11. Since, as viewed from the side of the slot 47, the part 48 of the bolt 12 is eccentrically offset towards the left as the cover 4 is inserted onto the base plate 3, a rotation of the bolt 12 in a clockwise direction has the result that the bolt portion 41 adjoining the lower edge of the left flat surface 42 is clamped to the hollow cylindrical inner wall (defining the space 11) of the receiving part 31. During the clamping operation, the cover 4 is simultaneously pressed against the wall surface on which the accessory is to be mounted. By appropriately designing the size and eccentricity of the bolt 12 as well as the size and distance of the surfaces 42 with their associated cylindrical space 11, the clamping motion may be determined within desired limits.

Turning now to the embodiment illustrated in FIGS. 8 through 11, FIGS. 8 and 9 show a base plate 3′ which has, at its opposite ends 34, an angled part 35 oriented away from the wall surface to which the base plate is to be attached. The angled parts 35 are at their outer surfaces provided with slightly oblique guiding faces 36. Centrally between the guide faces 36 there is arranged a receiving part 31′ having a circumferentially closed cylindrical space 11′.

Figure 10:
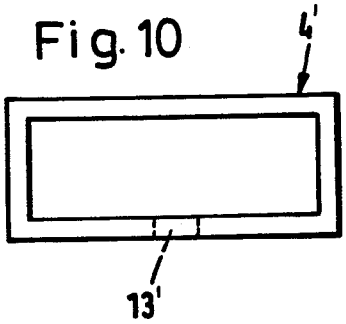
FIG. 10 is a bottom plan view of another component of the second preferred embodiment.
Figure 8:
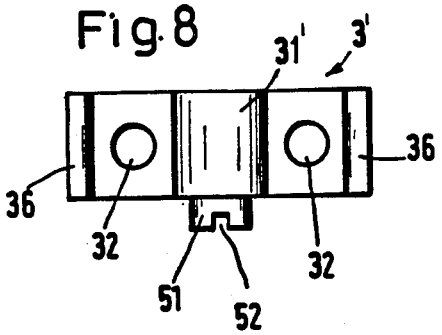
FIG. 8 is a top plan view of a component according to a second preferred embodiment of the invention.

FIG. 10 illustrates a cover 4′ supporting an accessory (not shown) and provided, in a side wall, with a circular opening (bearing) 13′.

Figure 11:
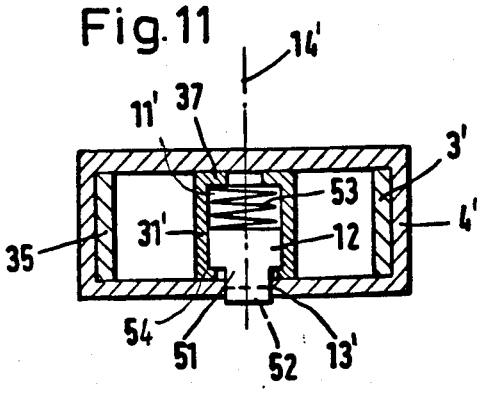
FIG. 11 is a sectional bottom plan view of an assembly formed of the component of FIGS. 8 and 9 and the component of FIG. 10.

FIG. 11 shows the base plate 3′ and the cover 4′ in an assembled state. One end of the receiving part 31′ has a radially inwardly extending flange 37, whereas the oppositely located end of the receiving part 11*a* is crimped radially inwardly at 54 after introduction of a clamping bolt 12′ during manufacture of the wall mount. The flanges 37 and 54 prevent the bolt 12′ from axially dropping out of the receiving part 31′ in the disassembled state of the wall mount. Thus, while in the previously described embodiment the clamping bolt 12 is supported in the cover 4, in the embodiment according to FIGS. 8–11 the clamping bolt 12′ is permanently accommodated in the cylindrical space 11′ of the receiving part 31′ forming a component of the base plate 3′. The bolt 12′ has a journal end 51 provided with a slot 52 for engagement with an externally introduced screwdriver. A compression spring 53 engages the bolt 12′ and is supported on the radially inwardly extending flange 37 of the receiving part 31′. Expediently, the compression spring 53 extends into a depression provided in an end face of the bolt 12′. The opposite end face of the bolt 12′ is pressed by the compression spring 53 against the crimped part 54 of the receiving part 31′. The journal end 51 of the bolt 12′ projects beyond the receiving part 31′ by an extent which is essentially identical to the thickness of the cover 4′ in that zone. The bearing 13′ provided in the cover 4′ serves as a support for the journal end 51, and defines a bearing axis 14′ (journal or rotary axis) for the bolt 12′. The diameter of the bearing 13′ is slightly larger than the diameter of the head 51 to provide for an easy axial introduction of the journal end 51 into the opening 13' when the cover 4' is placed on the base plate 3', already secured to a wall surface.

For connecting the cover 4' with the base plate 3', the cover 4' is, with its edge, moved over the base plate 3' whereby the end parts of the cover 4' are guided along the guide faces 36 of the base plate 3'. By pressing against the journal end 51 a final further displacement of the cover 4' is possible until its edge engages the wall or is in an immediate vicinity thereof. In this position the journal end 51 and the opening 13' are positioned farthest from the wall as viewed along the central plane of the wall mount. In this position, the slot 52 provided in the journal end 51 extends expediently perpendicularly to the wall surface. This arrangement ensures that the journal end 51 after pressing back against the effect of the compression spring 53 appears in the opening 13' of the cover 4'.

Thereafter, the journal end 51 merely has to be turned by a screwdriver in a clockwise or counterclockwise direction whereby the opening 13' together with the cover 4', guided on the guide faces 36, is moved towards the wall by the journal end 51 until the cover is firmly pressed against the wall. This displacement is caused by virtue of the bolt 12' which is eccentric with respect to the bearing axis 14' and which presses, in a camming action, against the upper part of the inner cylindrical wall face (defining the cylindrical space 11') of the receiving part 31'.

It will be understood that the above description of the present invention is susceptible to various modifications, changes and adaptations, and the same are intended to be comprehended within the meaning and range of equivalents of the appended claims.

What is claimed is:

1. A wall mount for an accessory, comprising (a) a base plate;

(b) means for affixing said base plate to a wall surface;

(c) a cover extending over said base plate in an assembled state of the wall mount; said cover including a throughgoing opening forming a first bearing having a bearing axis; said cover including a second bearing in alignment with said first bearing; and (d) clamping means for releasably tightening said cover to said base plate in the assembled state of said wall mount; said clamping means including (1) a receiving part affixed to said base plate and having an inner cylindrical wall defining a cylindrical space; and (2) a bolt having opposite first and second journal ends for being rotatably supported in said first and second bearings, respectively; said first and second journal ends having a common journal axis coinciding with said bearing axis; said bolt being rotatably supported in said first and second bearings and forming a unitary structure with said cover; said first journal end having a radial end face provided with a face portion shaped for engagement by a turning tool in the assembled state of the wall mount; said bolt having a length portion being eccentric with respect to said bearing axis; said receiving part having an elongated opening through which said length portion of said bolt is radially introducible into said cylindrical space upon placing said cover and said base plate into the assembled state; in said assembled state said bolt having a first angular position in which said length portion of said bolt is clamped to said inner cylindrical wall whereby said cover is drawn against said base plate and a second angular position in which said length portion of said bolt is in a released condition with respect to said inner cylindrical wall.

2. A wall mount as defined in claim 1, wherein said length portion of said bolt has diametrally opposed flat surfaces.

3. A wall mount as defined in claim 1, wherein said cover has a longitudinal central plane and further wherein said elongated opening is, in said assembled state, in alignment with said central plane and is oriented towards said cover.

4. A wall mount as defined in claim 1, further comprising a bearing plate affixed to said cover; said second bearing being provided in said bearing plate.

* * * * *

UNITED STATES PATENT AND TRADEMARK OFFICE

CERTIFICATE OF CORRECTION

PATENT NO. : 4,618,117

DATED : October 21, 1986

INVENTOR(S) : Helmut Gerbe

It is certified that error appears in the above-identified patent and that said Letters Patent is hereby corrected as shown below:

On the title page, under [73], the second line should read --KG, Hemer, Fed. Rep. of Germany--.

Signed and Sealed this

Thirtieth Day of December, 1986

*Attest:*

DONALD J. QUIGG

*Attesting Officer*

*Commissioner of Patents and Trademarks*